US005698942A

United States Patent [19]

Greene et al.

[11] Patent Number: 5,698,942

[45] Date of Patent: Dec. 16, 1997

[54] FIELD EMITTER FLAT PANEL DISPLAY DEVICE AND METHOD FOR OPERATING SAME

[75] Inventors: Richard F. Greene, Charlotte; Stephen M. Bobbio, Wake Forest; Farid M. Tranjan, Charlotte; Kasra Daneshvar, Charlotte; Thomas D. DuBois, Charlotte, all of N.C.

[73] Assignee: University of North Carolina, Charlotte, N.C.

[21] Appl. No.: 681,227

[22] Filed: Jul. 22, 1996

[51] Int. Cl.[6] ..... H01J 1/30

[52] U.S. Cl. ..... 313/497; 313/309; 313/336; 313/351; 313/310

[58] Field of Search ..... 313/495, 309, 313/336, 351, 310, 497; 315/169.4

[56] References Cited

U.S. PATENT DOCUMENTS

| | | | |
|---|---|---|---|
| 3,275,865 | 9/1966 | Van Oostrom et al. . | |
| 3,678,333 | 7/1972 | Coates et al. . | |
| 3,766,427 | 10/1973 | Coates et al. . | |
| 3,980,446 | 9/1976 | della Porta et al. . | |
| 4,417,184 | 11/1983 | Takesako et al. . | |
| 4,578,614 | 3/1986 | Gray et al. | 313/336 X |
| 4,612,483 | 9/1986 | Washington . | |
| 4,728,851 | 3/1988 | Lambe | 313/336 X |
| 4,904,895 | 2/1990 | Tsukamoto et al. | 313/336 |
| 5,030,895 | 7/1991 | Gray | 313/336 X |
| 5,063,323 | 11/1991 | Longo et al. . | |
| 5,083,958 | 1/1992 | Longo et al. . | |
| 5,155,416 | 10/1992 | Suzuki et al. . | |
| 5,191,217 | 3/1993 | Kane et al. . | |
| 5,216,324 | 6/1993 | Curtin | 313/497 X |
| 5,223,766 | 6/1993 | Nakayama et al. . | |
| 5,283,500 | 2/1994 | Kochanski . | |
| 5,315,207 | 5/1994 | Hoeberechts et al. . | |

OTHER PUBLICATIONS

Ralph E. Simon, "A solid-state boost for electron-emmison devices", *IEEE Spectrum*, Dec. 1972, pp. 74–78.

R. Z. Bakhtizin and S. S. Gots, "Flicker Noise in Semiconductor-Type Field-Emission Cathodes", Plenum Publishing Corporation, pp. 872–876, Dec. 1982.

*Primary Examiner*—Ashok Patel

*Attorney, Agent, or Firm*—Bell Seltzer Intellectual Property Law Group of Alston & Bird LLP

[57] ABSTRACT

A field emitter flat panel display and associated method of operation provides an electron emission path along which a beam of electrons emitted by a microelectronic field emitter travels such that the electrons impinge upon a light emitting element without passing through a mirror. The light emitting element is spaced apart from the microelectronic field emitter and includes a mirror and a luminescence layer on the mirror. The flat panel display can also include a deflector, such as a deflector electrode, which is spaced apart from both the microelectronic field emitter and the associated light emitting element and which controllably deflects the beam of electrons emitted by the microelectronic field emitter toward the luminescent layer of the associated light emitting element and along a curved electron emission path which is independent of the underlying mirror. Since the energy of the electrons is not dissipated by passing through a mirror prior to impinging upon the luminescent layer, the field emitter flat panel display and, more particularly, the microelectronic field emitter can be efficiently driven at relatively low voltage levels while still producing a relatively bright display.

21 Claims, 3 Drawing Sheets

FIELD EMITTER FLAT PANEL DISPLAY DEVICE AND METHOD FOR OPERATING SAME

FIELD OF THE INVENTION

The present invention relates generally to display devices and methods for operating display devices and, more particularly, to field emitter flat panel display devices and methods of operating field emitter flat panel display devices.

BACKGROUND OF THE INVENTION

The most common type of display device for electronic systems, such as computer systems and televisions, is a cathode ray tube (CRT). Notwithstanding their popularity, CRT's have a number of shortcomings. For example, CRT's are generally relatively large so as to occupy a significant spatial volume, have significant weight and have a large footprint. In addition, CRT's generally have a relatively low operating efficiency due to the use of thermionic electron sources which require a steady supply of power in order to remain hot. In addition, the tube of a CRT generally has a relatively short lifetime due, at least in part, to the high temperatures required to operate the thermionic electron sources which can exhaust the supply of barium oxide and similar chemicals within the CRT which are necessary to lower the energy barrier for thermionic emission.

In view of the shortcomings of CRT's, a number of alternative solid state displays devices, also typically referred to as flat panel displays, have been proposed. These flat panel display devices include light emitting diode displays, liquid crystal displays, electroluminescent displays and field emitter displays.

Field emitter flat panel displays generally include an array of field emitters, each of which includes a microelectronic emission surface to emit electrons. A field emitter includes at least a pair of electrodes, namely, an emitter electrode to supply electrons to the emitter and an extraction electrode which applies a negative voltage to the emitter relative to the extraction electrode. The field emitter flat panel display defines a vacuum space into which the electrons are emitted by the field emitters. Once emitted, the electrons impact upon a third electrode which is covered with color phosphors that emit light upon electron impact. The third electrode is also designed to remove or carry off the electronic charge imparted by the electrons.

While a field emitter can have a relatively flat surface formed of a material having low work function, field emitters generally have extremely sharply pointed shapes, called emitter tips. For example, the emitter tips can be conical or pyramidal in shape. The sharpness of the tip causes a given negative voltage, applied to the emitter tip with respect to the extraction electrode, to produce a high electric field. This so-called "field enhancement" greatly enhances the electron field emission produced by a given tip-to-extraction-electrode voltage. The high electric field is also enhanced by forming the extraction electrode close to the emitter tip, but not in such a position as to intercept electrons emitted from the emitter tip.

Field emitter flat panel display devices focus the beams of electrons which are controllably generated by the array of field emitters onto individually addressable color phosphor grains. Upon impingement of the electrons on the phosphor grains, the phosphor grains emit light of a predetermined color to form the resulting visual display. Conventional field emitter flat panel display devices also include a transparent face plate through which the display is viewed and to which the phosphor grains are attached. For example, the phosphor grains can be attached to the transparent face plate with an organic matrix.

Typically, the array of field emitters is disposed in a rear portion of the flat panel display device and the transparent face plate with the color phosphor grains attached thereto covers a front or forward portion of the flat panel display device. Accordingly, upon application of a sufficient voltage between the respective emitter electrodes and extraction electrodes, the field emitter tips emit beams of electrons which travel forwardly along a generally straight electron emission path in a vacuum to contact the appropriate color phosphor grains, which, in turn, emit light of a predetermined color.

Upon impingement by a beam of electrons, the phosphor grains emit light in all directions. In order to direct the emitted light outwardly through the transparent face plate and towards a viewer, conventional field emitter flat panel display devices also include a light reflector (mirror). The mirror is typically formed of a solid layer of aluminum that is disposed between the array of field emitters and the layer of phosphor grains. For example, the layer of phosphor grains can be sandwiched between the mirror and the transparent face plate and may be adhered to both the light reflector and the transparent face plate with an organic matrix. Consequently, the electrons emitted by the array of field emitters of a conventional field emitter flat panel display device must pass through the mirror and the organic matrix layer prior to impinging upon the respective phosphor grains.

In the CRT, a high voltage is required to provide one or a small number of electron beams with sufficient energy to be focused and rastered in a sequential manner to the phosphor grains disposed at widely spaced picture element regions (pixels) over the entire light-emitting area of the phosphor grains on the distant face-plate of the CRT. In a flat panel display, however, each pixel of phosphor grains is excited by a respective electron beam, that is, the flat panel display provides as many electron beams as there are picture elements. In addition, the electron paths are extremely short, and are not directed or "rastered" over widely spaced picture elements. As a result, the electron beams of a flat panel display can reach their target areas under a much lower voltage than is employed in a CRT display. This short beam travel distance is the basis of the flatness that can be achieved by a field emission flat panel display.

For the reasons described above, color CRT's require high voltages, such as 25,000 volts, in order to operate, while field emitter flat panel displays can operate with much lower voltages, e.g., 500–1000 volts, applied to the electrons following emission by the emitter tip. As a result of this low voltage operation, the cost and weight of a field emitter flat panel display is significantly decreased relative to CRT's.

In both CRT's and field emitter flat panel displays, the energy of incident electrons is the source of energy for the emission of light from the phosphors. As a result, any loss of electron energy translates into a loss of efficiency, that is, a decrease in the ratio of light emitted to the power required to operate the display. In addition, decreasing the voltage levels at which conventional field emitter flat panel displays operate also lowers the operating efficiency of the displays. This efficiency loss is due to the structure of a conventional flat panel display, namely, a structure resembling that of the CRT which requires electrons on their way to the phosphor grains to pass through a thin metal mirror, such as an aluminum mirror, which is designed to cause the light that is emitted in a direction away from the viewer to be reflected into the direction toward the viewer.

While passing electrons through a metal mirror is not a problem for a CRT which operates a high voltage, such as 25,000 volts, the traversal of the electrons through the metal mirror becomes a serious efficiency problem for a flat panel display which operates at significantly lower voltages, such as 500–1000 volts. For example, in flat panel displays, the lower voltage electrons lose a significant portion of their energy in traversing the aluminum mirror inasmuch as their inelastic mean free path, i.e., the distance which such electrons can travel before losing 1–20 volts of energy, is only about 20 Angstroms, whereas the aluminum mirror thickness must be 500 Angstroms or more to reflect light efficiently.

The loss of electron energy in traversing the mirror corresponds to waste of energy as heat, rather than the useful emission of light. In addition, this energy loss is proportionally much higher and more serious for the field emitter flat panel display than for the CRT display because the energy loss is only weakly dependent on electron energy and, hence, proportionally higher for a field emitter flat panel display. Furthermore, the inelastic mean free path of electrons is only a weak function of incident electron energy and, therefore, is much more serious at the low electron energy levels employed by flat panel displays.

SUMMARY OF THE INVENTION

It is therefore an object of the present invention to provide an efficient field emitter flat panel display.

It is another object of the present invention to provide a flat panel display having a relatively bright luminescence during operation at relatively low power levels.

These and other objects are provided, according to the present invention, by a field emitter flat panel display and associated method of operation which emits a beam of electrons which travel along an electron emission path toward a luminescent layer such that the beam of electrons impinge upon the luminescent layer without passing through a mirror. Accordingly, the microelectronic field emitters of the field emitter flat panel display can be driven at relatively low voltage levels while still producing a bright display since the energy of the electrons is not dissipated by passing through a mirror prior to impinging upon the luminescent layer. Accordingly, the field emitter flat panel display of the present invention provides a relatively bright display in an efficient manner without requiring that the microelectronic field emitters be driven at the relatively high power levels demanded by conventional field emitter flat panel displays. Due to the geometry of the field emitter flat panel display of the present invention, the electrons also preferably strike the luminescent layer from the general direction of the viewer so as to minimize the light reabsorbed by the luminescent layer.

According to one embodiment, the flat panel display of the present invention includes a substrate, a microelectronic field emitter on the substrate and a light emitting element spaced apart from the microelectronic field emitter such that a electron emission path is defined therebetween. In one advantageous embodiment, the light emitting element is also disposed on the substrate and adjacent the microelectronic field emitter. The flat panel display can also include a deflector for controllably deflecting electrons emitted by the microelectronic field emitter along a curved electron emission path and toward the light emitting element.

The light emitting element of the field emitter flat panel display includes a mirror and a luminescent layer on the mirror for producing luminescence upon impingement of electrons thereon. According to one embodiment, the mirror is disposed on the substrate. According to another embodiment, however, the light emitting element can also include an insulating layer on the substrate and extending between the substrate and the mirror. Preferably, the substrate has a first predetermined breakdown voltage and the insulating layer has a second predetermined breakdown voltage which is greater than the first predetermined breakdown voltage such that the light emitting element can support higher voltage levels without breaking down.

According to one embodiment, the microelectronic field emitter includes an electron emitting element and at least one extraction electrode extending proximate to and insulated from the electron emitting element for extracting electrons from the electron emitting element upon application of a sufficient voltage therebetween. In this regard, the field emitter flat panel display can also include an at least partially conductive emitter contact on the substrate between the substrate and the electron emitting element and insulated from the extraction electrode.

In one preferred embodiment, the field emitter flat panel display includes a plurality of microelectronic field emitters, typically arranged as an array of individually electrically addressable microelectronic field emitters. According to this embodiment, the flat panel display also includes a plurality of light emitting elements associated with and adjacent to respective ones of the microelectronic field emitters. Thus, the electrons emitted by the microelectronic field emitters will travel toward the associated light emitting element and, more preferably, will be deflected by the deflector to the associated light emitting element. According to this embodiment, each microelectronic field emitter and associated light emitting element define a pixel of the resulting flat panel display. Accordingly, a relatively large flat panel display can be provided by the present invention.

According to one advantageous embodiment, the field emitter flat panel display provides a color display. Accordingly, the luminescent layer of this embodiment preferably includes a plurality of luminescent regions, each of which includes phosphor grains adapted to emit light of a predetermined color upon impingement of electrons therewith. In addition, the flat panel color display of this embodiment can include deflection control means, operably connected to a second deflector, for controllably deflecting the electrons extracted from the electron emitting element toward a respective luminescent region. Thus, upon application of an appropriate voltage, the microelectronic field emitter emits a beam of electrons which can be controllably deflected toward the associated light emitting element and, more preferably, toward a respective luminescent region of the associated light emitting element such that the luminescent region emits light of a predetermined color, thereby creating the desired visible color image.

The field emitter flat panel display also typically includes an at least partially transparent face plate through which the visible image is viewed. According to one embodiment, a deflector is also at least partially transparent and is disposed between the substrate and the face plate such that the microelectronic field emitter and the light emitting element are on a first side of this deflector and the face plate is on a second side of this deflector. More preferably, the deflector of this embodiment is also at least partially conductive and is disposed upon an inner surface of the face plate in order to prevent an accumulation of charge on the face plate. According to another embodiment, a second deflector includes a deflector electrode disposed upon and insulated from the extraction electrode of the microelectronic field emitter.

Therefore, the electrons extracted from the microelectronic field emitters of the flat panel display of the present invention travel toward the luminescent layer along an electron emission path which is independent of the mirror. In other words, the electrons which are emitted by the microelectronic field emitters travel along the electron emission path so as to impinge upon the luminescent layer without passing through a mirror. Accordingly, the electrons do not lose energy while passing through the mirror. As a result, the microelectronic field emitters can be driven at relatively low power levels. However, the luminescence of the field emitter flat panel display of the present invention remains relatively bright since the light emitted by the luminescence layer can be reflected through the face plate of the flat panel display by the mirror which is preferably disposed between the substrate and the luminescent layer, but which is not within the electron emission path. Accordingly, the field emitter flat panel display of the present invention provides significantly enhanced efficiency by producing bright images with relatively low power levels.

DETAILED DESCRIPTION OF THE PREFERRED EMBODIMENTS

Figure 1:
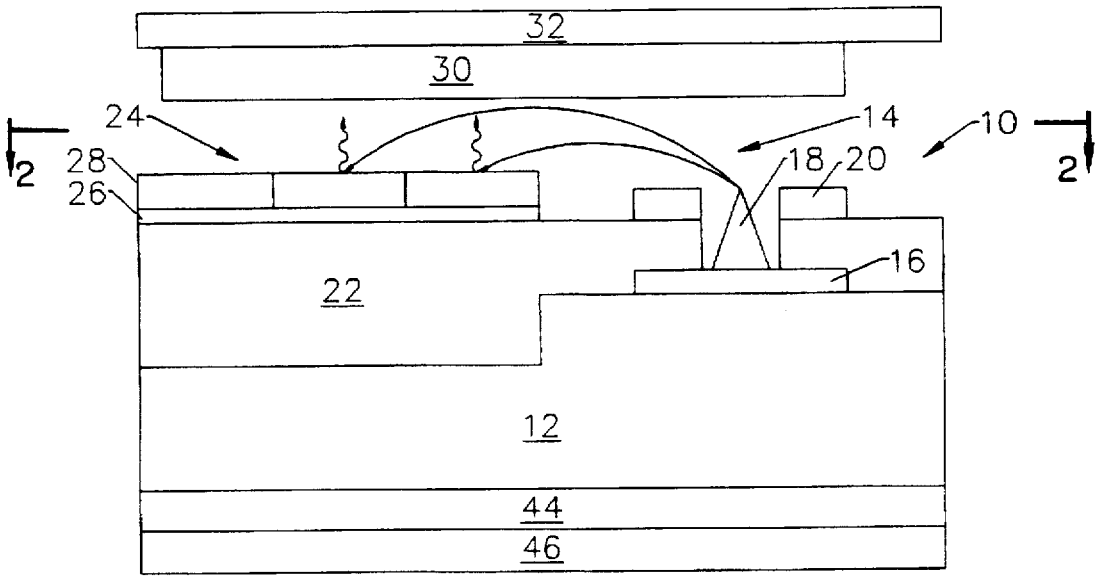
FIG. 1 is a cross-sectional view of a field emitter flat panel display according to one embodiment of the present invention.

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. In the drawings, the thicknesses and spacing of the layers and regions are exaggerated for clarity. Like numbers refer to like elements throughout.

Figure 3:
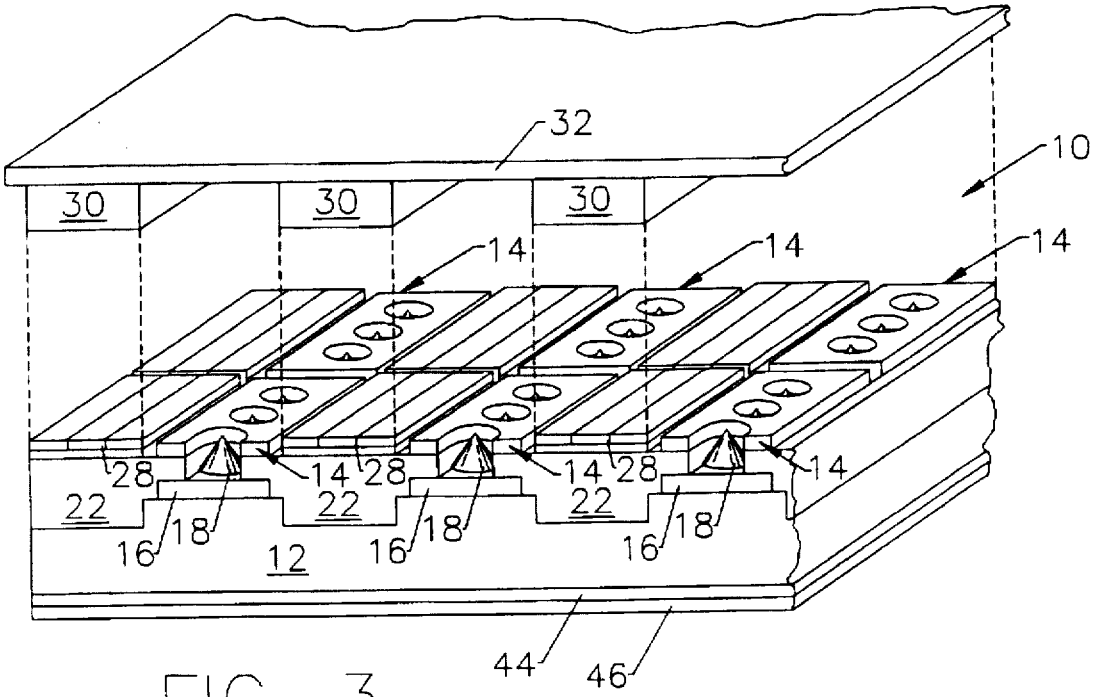
FIG. 3 is a partial perspective view of a field emitter flat panel display according to one embodiment of the present invention which includes an array of microelectronic field emitters and associated light emitting elements.

Referring now to FIG. 1, the cross-sectional view of the flat panel display 10 according to one embodiment of the present invention is illustrated. As illustrated in FIG. 1, the flat panel display is shown to include a single display element or pixel. More typically, however, the flat panel display includes a plurality of display elements or pixels arranged in an array as described in more detail below and as shown in FIG. 3.

Figure 2:
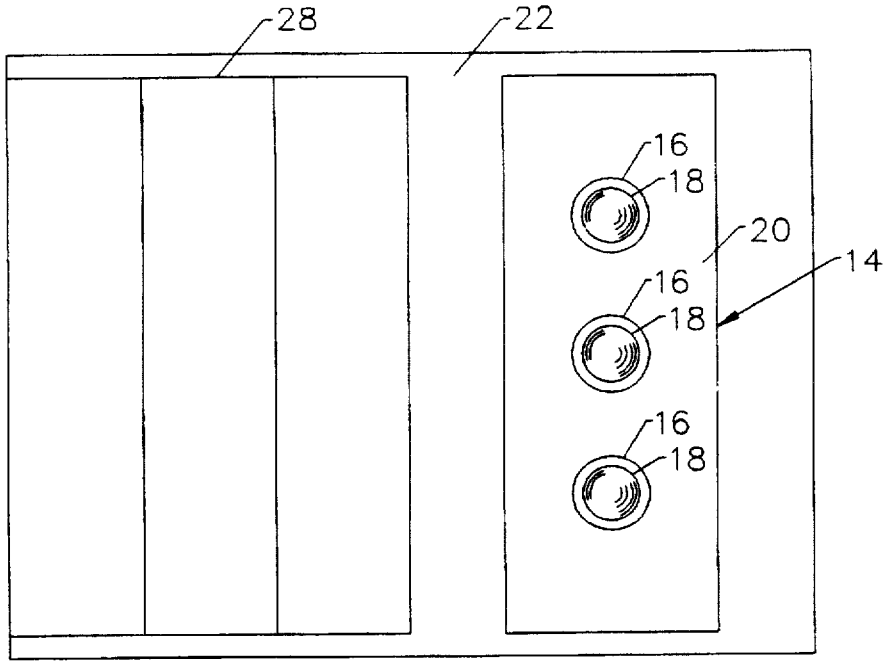
FIG. 2 is a top view of the field emitter flat panel display of FIG. 1 taken along line 2—2 in which the face plate and the deflector have been removed for purposes of illustration.

As shown in FIGS. 1 and 2, the flat panel display 10 of one embodiment of the present invention includes a substrate 12 on which a microelectronic field emitter 14 is disposed. While the substrate can be formed of a number of materials, the substrate of one embodiment is formed of $SiO_2$ having a first predetermined breakdown voltage. It will be understood by those having skill in the art that when an element is described herein as being "on" another element, it may be formed directly on the element, at the top, bottom or side surface area, or one or more intervening layers may be provided between the elements. Accordingly, the microelectronic field emitter may be formed directly on the substrate, or one or more intervening layers may be included between the substrate and the microelectronic field emitter, as shown.

As illustrated in FIG. 1, the flat panel display 10 also includes an at least partially conductive emitter contact 16 on the substrate 12. While the emitter contact can be formed of a semiconductor material, the emitter contact is preferably formed of a metal, such as aluminum, tungsten or molybdenum. The microelectronic field emitter 14 is then formed on the emitter contact. As also shown in FIG. 1, the microelectronic field emitter includes an electron emitting element or tip 18 which extends outwardly from the emitter contact and the substrate to a point or tip. As known to those skilled in the art, the electron emitting element can have a variety of shapes including conical, pyramidal and linear pointed tips having a relatively small radius of curvature in order to enhance electron emission therefrom. According to one embodiment, the electron emitting element is formed of a p-type or n-type semiconductor material, such as p-doped or n-doped Ge, Si, InSb, PbS, PbTe or HgCdTe. According to another embodiment, the electron emitting element is formed of a metal, such as molybdenum, tungsten or nickel. However, the electron emitting element can be formed of other semiconductor materials or metals without departing from the spirit and scope of the present invention.

The microelectronic field emitter 14 also includes at least one extraction electrode 20 extending proximate to and insulated from the electron emitting element 18. Accordingly, the microelectronic field emitter defines an electron emission gap between the extraction electrode and the electron emitting element. Thus, by applying an appropriate voltage, such as 50 volts or more, between the extraction electrode and the electron emitting element and, more particularly, between the extraction electrode and the emitter contact 16, electrons can be extracted from the electron emitting element.

As also shown in FIG. 1, the extraction electrode 20 is preferably separated from the emitter contact 16 by an insulating layer 22 which is formed on the substrate 12 and on at least a portion of the emitter contact surrounding and spaced apart from the electron emitting element 18. While the extraction electrode and the insulating layer can be formed of a variety of materials, the extraction electrode is preferably formed of a metal, such as aluminum, tungsten or nickel, and the insulating layer is preferably formed of an insulating material, such as $SiO_2$ or $Si_3N_4$. According to one advantageous embodiment, the insulating layer has a second predetermined breakdown voltage which is greater than the first predetermined breakdown voltage of the substrate. Accordingly, the insulating layer can support higher voltage levels without damage, as described below.

As shown in FIG. 2, a single display element or pixel can include a plurality of electron emitting elements 18. While the display element of FIG. 2 includes three electron emitting elements, the display element can include any number of electron emitting elements without departing from the spirit and scope of the present invention. Typically, the electron emitting elements have circular, pyramidal or wedge-shaped cross-sectional shapes. While the individual electron emitting elements can be spaced as desired, the electron emitting elements are preferably spaced apart by a distance significantly greater than the radius of curvature of the electron emitting elements or tips. As also shown in FIG. 2, the display element can include a single extraction electrode 20 for simultaneously extracting electrons from each of the electron emitting elements. However, the display element can include separate extraction electrodes associated with respective electron emitting elements without departing from the spirit and scope of the present invention.

As shown in FIG. 1, the flat panel display 10 of the present invention also includes a light emitting element 24 which is spaced apart from the microelectronic field emitter 14. According to one advantageous embodiment, the light emitting element is disposed on the substrate 12 and adjacent the microelectronic field emitter. As described below, electrons extracted by the microelectronic field emitter travel toward the light emitting element along an electron emission path.

Figure 4:
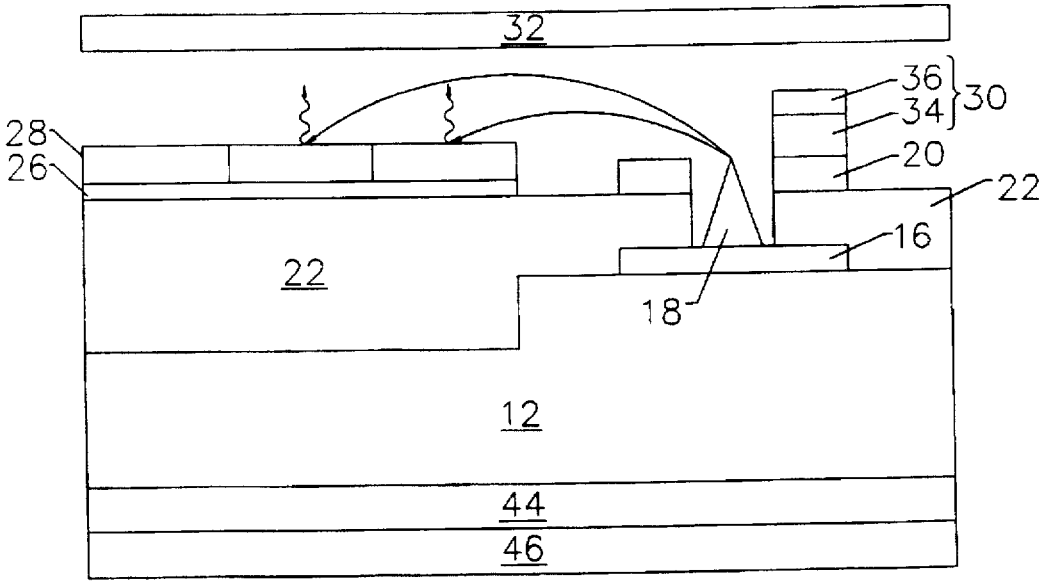
FIG. 4 is a cross-sectional view of a field emitter flat panel display according to another embodiment of the present invention.

The light emitting element 24 preferably includes a mirror 26 or reflector layer which, according to one embodiment, is disposed on the substrate 12. However, the light emitting element, including the mirror, need not be disposed upon the substrate according to the present invention. As illustrated in FIGS. 1 and 4 and as described below, the mirror is outside of the electron emission path such that the extracted electrons do not pass through the mirror to impinge upon the light emitting element. The mirror can be formed of a thin film of a variety of at least partially light-reflective materials, such as aluminum. While the mirror is generally a relatively thin film, the mirror must generally have a thickness greater than about 50 nanometers in order to appropriately reflect light emitted by the light emitting element. A positive voltage of about 100–1000 volts is preferably applied to the mirror in order to accelerate the emitted electrons to the desired energy for exciting the phosphor grains to emit the desired light.

The light emitting element 24 also includes a luminescent layer 28 on the mirror 26 for producing luminescence upon impingement of electrons thereon. The luminescent layer is generally formed of a luminescent phosphor, such as zinc sulfide or zinc selenite. According to one advantageous embodiment, the field emitter flat panel display 10 of the present invention provides a color display. Accordingly, the luminescent layer of this embodiment preferably includes a plurality of luminescent regions, each of which includes phosphor adapted to emit light of a predetermined color upon impingement of electrons therewith. For example, in the embodiment of the flat panel display shown in FIGS. 1 and 2, the luminescent layer includes three regions formed of phosphor adapted to emit red light, blue light and green light, respectively, upon impingement of electrons therewith.

In operation, the light emitting element 24 may be subjected to significantly higher voltage levels than the microelectronic field emitter 14. Thus, the insulating layer 22 on which the light emitting element is disposed is preferably adapted so as to withstand these higher voltage levels. For example, the insulating layer is preferably formed of an insulating material which has a predetermined breakdown voltage which is greater than the predetermined breakdown voltage of the substrate 12. In addition, the thickness of that portion of the insulating layer on which the light emitting element is disposed is preferably greater than that portion of the insulating layer on which the microelectronic field emitter is disposed. Due to this increased thickness, the light emitting element can be subjected to significantly higher voltage levels than the microelectronic field emitter without breaking down the insulating layer.

As shown in FIGS. 1, 3 and 4, the thickness of the substrate 12 can also be varied in order to compensate or offset the thickness variations of the insulating layer 22. For example, the portion of the substrate on which a microelectronic field emitter 14 is disposed can be thicker than the portion of the substrate on which the associated light emitting element 24 is disposed. It should be apparent, however, that the flat panel display 10 of the present invention can include a substrate having a planar surface on which the microelectronic field emitters and light emitting elements are disposed without departing from the spirit and scope of the present invention.

The flat panel display 10 of one advantageous embodiment also includes a deflector 30 disposed in a spaced relation to both the luminescent layer 28 and the electron emitting element 18. As described in detail hereinbelow, the deflector controllably deflects the electrons emitted by the electron emitting element along an electron emission path toward the luminescent layer. Typically, the deflector controllably deflects the emitted electrons such that the electron emission path is substantially curved. For purposes of illustration, a pair of exemplary curved electron emission paths are shown in FIG. 1 in which the electrons emitted by the electron emitting element are deflected toward the first and second regions of the luminescent layer.

By fabricating the flat panel display 10 as described above and as illustrated herein, the electron emission path is independent of the mirror 26. In other words, the electrons emitted by the electron emitting element 18 are deflected by the deflector 30 so as to impinge upon the luminescent layer 28 without ever passing through of otherwise contacting the mirror. Accordingly, the electrons do not lose energy by passing through the mirror prior to impinging upon the luminescence layer. As a result, it is believed that the flat panel display of the present invention can emit light of the same luminescence or brightness as a conventional flat panel display without requiring the electrons to have as great of an initial energy. Consequently, the microelectronic field emitter 14 can be driven at relatively low voltage levels, such as about +50 volts with respect to the electron emitting element, while continuing to produce a relatively bright display. By producing a visual display of a relatively high brightness or luminescence with significantly reduced power input, the overall efficiency of the flat panel display of the present invention is significantly increased.

The flat panel display 10 also generally includes a face plate 32. The face plate is typically formed of an at least partially transparent material, such as glass, fused quartz or plastic. As known to those skilled in the art, the face plate is generally sealed about the edges to form a vacuum chamber in which the electrons which are emitted by the electron emitting element 18 are deflected by the deflector 30 and impinge upon the luminescent layer 28 of the light emitting element 24. Although not illustrated, the flat panel display also generally includes a getter or gettering system to remove unwanted gas from within the vacuum chamber of the flat panel display as known to those skilled in the art.

According to one embodiment of the present invention, the deflector 30 is disposed between the substrate 12 and the face plate 32 and, more preferably, is disposed upon the inner surface of the face plate. Therefore, as shown in FIG. 1, the microelectronic field emitter 14 and the light emitting element 24 are on opposite sides of the deflector from the face plate. Accordingly, the light emitted by the luminescent layer 28 upon impingement of electrons thereon must pass through both the deflector and the face plate. Thus, the deflector of this embodiment is at least partially transparent.

In order to prevent an accumulation of charge on the face plate, the deflector is preferably at least partially conductive. For example, the deflector can be formed of tin oxide or indium tin oxide. However, the deflector can be formed of other materials without departing from the spirit and scope of the present invention.

The flat panel display 10 of the present invention can include other types of deflectors 30 without departing from the spirit and scope of the present invention. For example, an alternative embodiment of the flat panel display is shown in FIG. 4 which includes a second deflector which, in turn, includes a deflector insulating layer 34 on at least a portion of the extraction electrode 20, and a second deflector electrode 36 on the deflector insulating layer for controllably deflecting the extracted electrodes towards the desired portion of the luminescent layer 28. While the deflector insulating layer and the second deflector electrode can be formed of a variety of materials, the second deflector of one embodiment includes a deflector insulating layer formed of $SiO_2$ or $Si_3N_4$ and a second deflector electrode formed of a metal, such as aluminum, tungsten or nickel.

As shown in FIG. 3, the flat panel display 10 of the present invention generally includes a plurality of display elements or pixels. Each pixel typically includes a microelectronic field emitter 14, an associated light emitting element 24 and a deflector 30 for controllably deflecting the electrons emitted by the microelectronic field emitter toward the associated light emitting element. Thus, the flat panel display of the present invention can include a plurality of microelectronic field emitters and a plurality of light emitting elements associated with and adjacent to respective ones of the microelectronic field emitters as shown in FIG. 3.

The flat panel display 10 is preferably fabricated according to conventional integrated circuit or semiconductor fabrication processes. This, even though a flat panel display may include a large number of display elements, each display element can be relatively small, such as less than about 100 square micrometers or, more preferably, less than about 20 square micrometers. Accordingly, the flat panel display can include an array of miniature display elements which provide the relatively high levels of resolution required for high definition television and heads up display applications, for example.

As known to those skilled in the art, the operation of a flat panel display 10 is controlled such that predetermined visual images are provided. As shown schematically in FIG. 5, the operation of a flat panel display is generally controlled by a display controller 40 which typically includes one or more microprocessors or microcontrollers. The display controller supplies control signals, in turn, to the field emitter tip drive electronics 42, the deflector control means 46 and the extraction electrode drive electronics 44. The field emitter tip drive electronics are in electrical communication with the emitter contact 16 of each respective microelectronic field emitter 14. Likewise, the extraction electrode drive electronics is in electrical communication with the extraction electrode 20 of each microelectronic field emitter. Accordingly, the field emitter tip drive electronics and the extraction electrode drive electronics can establish a predetermined voltage across the electron emission gap defined between the electron emitting element 18 and the extraction electrode to thereby extract electrons from the electron emitting element.

According to one advantageous embodiment, the extraction electrode drive electronics 44 can include a thin film transistor circuit, such as the thin film transistor circuits utilized by liquid crystal displays. The thin film transistor circuit can include an active matrix of transistors, at least one of which is electrically connected to each extraction electrode 20. As shown in FIGS. 1, 3 and 4, the thin film transistor circuit can be formed within an amorphous or polycrystalline silicon layer on a rear surface of the substrate 12, opposite the microelectronic field emitter 14 and the light emitting element 24. However, the extraction electrode drive electronics can be formed in other manners without departing from the spirit and scope of the present invention.

Figure 5:
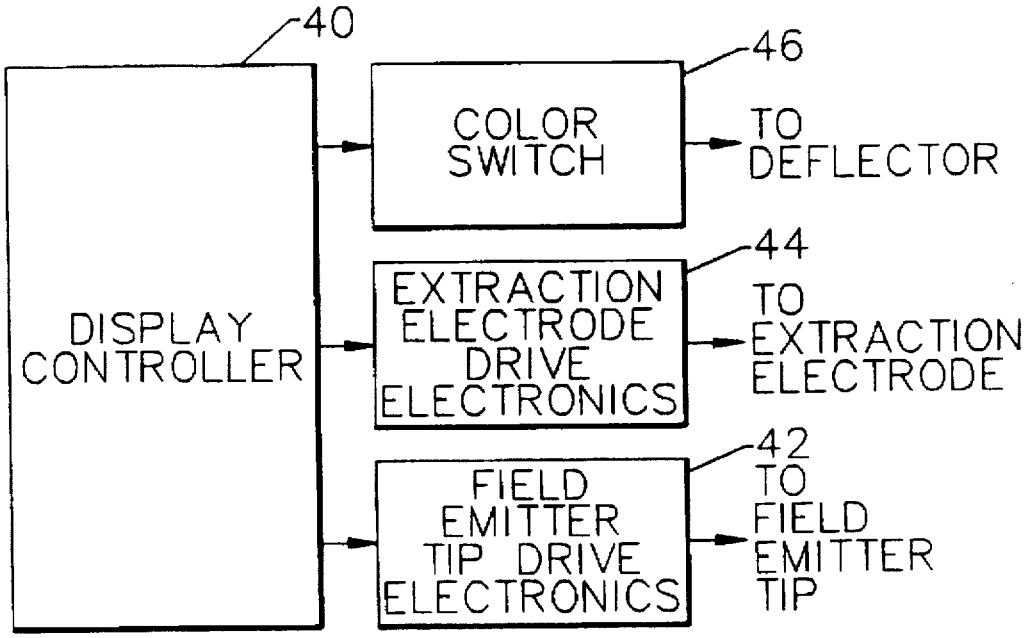
FIG. 5 is a block diagram of the control electronics of a field emitter flat panel display according to one embodiment of the present invention.

As shown in FIG. 5, the display controller 40 also provides control signals to a deflection control means 46, such as a color switch, which, in turn, is in electrical communication with the deflector 30 associated with each microelectronic field emitter 14 of the flat panel display 10. Although the deflection control means can be provided in a number of manners without departing from the spirit and scope of the present invention, the deflection control means can include a color switch formed in an amorphous silicon layer on the rear surface of the substrate 12, opposite the microelectronic field emitter and the light emitting element 24. The color switch can then be electrically connected to the deflector as known to those skilled in the art.

By applying different predetermined voltages to the deflector 30, the deflection control means 46 controllably deflects the electrons emitted by the microprocessor field emitter 14 toward the specific phosphor region of the associated luminescent layer 28. In embodiments of the present invention in which the flat panel display 10 is a color display, the deflection control means controllably deflects the electrons emitted by the microelectronic field emitter toward a respective luminescent region such that the phosphor of the respective luminescent region emits light of the predetermined color upon impingement of the deflected electrons therewith. Thus, by controlling the voltage applied to the deflector, the deflection control means controls the deflection of the emitted electrons such that light of the desired color is emitted.

As known to those skilled in the art, the deflection control means 46 preferably provides a cyclical voltage to the deflector 30 such that electrons would be sequentially deflected toward the first luminescent region, the second luminescent region, the third luminescent region, the first luminescent region, the second luminescent region and so on. Accordingly, the display controller 40 and, more particularly, the field emitter tip drive electronics 42 and the extraction electrode drive electronics 44 can provide the appropriate voltage across the electron emission gap between the extraction electrode 20 and the electron emitting element 18 at a point in time relative to the cyclical voltage applied to the deflector such that the emitted electrons will be deflected toward a predetermined luminescent region in order to emit light of the desired color.

As described above, the flat panel display 10 of the present invention includes a microelectronic field emitter which emits electrons for travel toward a luminescent layer 28 along an electron emission path which is independent of the mirror 26. In other words, the electrons which are emitted by the microelectronic field emitters 14 travel toward the luminescent layer of the associated light emitting element 24, typically along a curved electron emission path controlled by a deflector, without passing through the mirror. Accordingly, the electrons do not lose energy while passing through a mirror. As a result, the microelectronic field emitters can be driven at relatively low power levels while continuing to produce a bright visual image. Accordingly, the field emitter flat panel display of the present invention provides significantly enhanced efficiency by producing bright images with relatively low power levels.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. A flat panel display comprising:

a substrate;

a microelectronic field emitter on said substrate, said microelectronic field emitter comprising an electron emitting element for emitting electrons;

a light emitting element on said substrate, said light emitting element comprising:

a mirror; and a luminescent layer on said mirror for producing luminescence upon impingement of electrons thereon; and at least one deflector, spaced apart from said microelectronic field emitter and said light emitting element, for controllably deflecting the electrons emitted by said microelectronic field emitter along a predefined electron emission path prior to impinging upon said luminescent layer, and wherein said luminescent layer is positioned relative to said microelectronic field emitter such that the electron emission path is independent of said mirror, thereby permitting the electrons emitted by said microelectronic field emitter to impinge upon said luminescent layer without passing through said mirror.

2. A flat panel display according to claim 1 wherein said luminescent layer comprises a plurality of luminescent regions, and wherein each luminescent region comprises a phosphor adapted to emit light of a predetermined color upon impingement of electrons therewith.

3. A flat panel display according to claim 2 further comprises deflection control means, operably connected to said deflector, for controllably deflecting the electrons emitted by said microactuator field emitter toward a respective luminescent region such that said phosphor of the respective luminescent region emits light of a predetermined color upon impingement of the deflected electrons therewith.

4. A flat panel display according to claim 1 further comprising an at least partially transparent face plate, wherein said deflector is at least partially transparent and is disposed between said substrate and said face plate such that said microelectronic field emitter and said light emitting element are on a first side of said deflector and said face plate is on a second side of said deflector.

5. A flat panel display according to claim 4 wherein said deflector is disposed upon an inner surface of said face plate, and wherein said deflector is at least partially conductive.

6. A flat panel display according to claim 1 wherein said microelectronic field emitter further comprises at least one extraction electrode extending proximate to said electron emitting element for extracting electrons therefrom, and wherein said deflector comprises a deflector electrode disposed upon and insulated from said extraction electrode for controllably deflecting the extracted electrons toward said luminescent layer.

7. A flat panel display according to claim 1 further comprising:

an array of microelectronic field emitters disposed in a predetermined pattern on said substrate; and a plurality of light emitting elements associated with and adjacent to respective ones of said microelectronic field emitters such that the electrons emitted by the microelectronic field emitters impinge upon the associated light emitting element, wherein each microelectronic field emitter and associated light emitting element define a pixel of the flat panel display.

8. A flat panel display comprising:

a substrate;

an electron emitting element on said substrate;

an insulating layer on said substrate, said insulating layer extending proximate said electron emitting element;

at least one extraction electrode on said insulating layer proximate said electron emitting element for extracting electrons therefrom;

a mirror on said insulating layer in a spaced relation to said at least one extraction electrode; and a luminescent layer on said mirror for producing luminescence upon impingement of the extracted electrons thereon.

9. A flat panel display according to claim 8 further comprising at least one deflector, disposed in a spaced relation to both said luminescent layer and said electron emitting element, for controllably deflecting the extracted electrons toward said luminescent layer.

10. A flat panel display according to claim 9 wherein said luminescent layer comprises a plurality of luminescent regions, and wherein each luminescent region comprises a phosphor adapted to emit light of a predetermined color upon impingement of electrons therewith.

11. A flat panel display according to claim 10 further comprises deflection control means, operably connected to said deflector, for controllably deflecting the electrons extracted from said electron emitting element toward a respective luminescent region such that said phosphor of the respective luminescent region emits light of a predetermined color upon impingement of the deflected electrons therewith.

12. A flat panel display according to claim 11 wherein said deflection control means comprises a color switch disposed on a surface of said substrate opposite said emitter contact and said insulating layer.

13. A flat panel display according to claim 9 wherein said deflector comprises:

a deflector insulating layer on at least a portion of said extraction electrode; and a deflector electrode on said deflector insulating layer for controllably deflecting the extracted electrons toward regions of said luminescent layer.

14. A flat panel display according to claim 9 further comprising a face plate disposed upon a surface of said deflector opposite said electron emitting element and said luminescent layer.

15. A flat panel display according to claim 8 further comprising an at least partially conductive emitter contact on said substrate between said substrate and said electron emitting element.

16. A flat panel display according to claim 8 wherein said substrate has a first predetermined breakdown voltage and said insulating layer has a second predetermined breakdown voltage, and wherein the second predetermined breakdown voltage is greater than the first predetermined breakdown voltage.

17. A method of displaying a visible image comprising the steps of:

providing a flat panel display comprising a substrate, a microelectronic field emitter on the substrate, and a light emitting element on the substrate, wherein the light emitting element has a mirror and a luminescent layer on the mirror;

applying a voltage to the microelectronic field emitter to produce electron emission therefrom, wherein said voltage applying step comprises the step of extracting electrons from the microelectronic field emitter;

controllably deflecting the extracted electrons toward the light emitting element such that the extracted electrons travel toward the light emitting element along an electron emission path which is independent of the mirror;

impinging the extracted electrons onto the luminescent layer without passing through the mirror to produce luminescence; and reflecting at least a portion of the luminescence produced by the impingement of the electrons upon the luminescent layer to create the visible image.

18. A method according to claim 17 wherein said step of controllably deflecting the extracted electrons further comprises the step of controllably deflecting the extracted electrons along a curved electron emission path and toward the luminescent layer.

19. A method according to claim 18 wherein said providing step comprises providing a flat panel display having a luminescent layer that includes a plurality of luminescent regions, wherein each luminescent region comprises phosphor adapted to emit light of a predetermined color upon impingement of electrons therewith, and wherein the method further comprises the step of emitting light of a predetermined color upon the impingement of electrons with a respective one of the luminescent regions.

20. A method according to claim 19 wherein said deflecting step further comprises controllably deflecting the emitted electrons toward a respective luminescent region such that the phosphor of the respective luminescent region emits light of a predetermined color upon impingement of the deflected electrons therewith.

21. A method according to claim 18 wherein said providing step comprises providing a plurality of microelectronic field emitters on the substrate and a plurality of light emitting elements, associated with respective ones of the microelectronic field emitters, on the substrate, wherein said applying step comprises applying a voltage to respective microelectronic field emitters to produce electron emission from the respective microelectronic field emitters, and wherein said step of controllably deflecting the extracted electrodes comprises deflecting the electrons emitted by the respective microelectronic field emitters toward the associated luminescent layer to thereby define a respective electron emission path between each microelectronic field emitter and the associated luminescent layer.

* * * * *